US012214921B2

(12) United States Patent
Yeo

(10) Patent No.: US 12,214,921 B2
(45) Date of Patent: Feb. 4, 2025

(54) STRAPPING HEAD MONITORING SYSTEM FOR PACKING COIL THROUGH SELECTIVE SENSING OF BINDING FORCE OF BAND FOR PACKING COIL

(71) Applicant: JPS CO., LTD., Gimhae-si (KR)

(72) Inventor: Dong Hoon Yeo, Gimhae-si (KR)

(73) Assignee: JPS CO., LTD., Gimhae (KR)

( * ) Notice: Subject to any disclaimer, the term of this patent is extended or adjusted under 35 U.S.C. 154(b) by 0 days.

(21) Appl. No.: 17/612,163

(22) PCT Filed: Nov. 10, 2021

(86) PCT No.: PCT/KR2021/016311

§ 371 (c)(1),
(2) Date: Nov. 17, 2021

(87) PCT Pub. No.: WO2022/270690

PCT Pub. Date: Dec. 29, 2022

(65) Prior Publication Data

US 2024/0417124 A1 Dec. 19, 2024

(30) Foreign Application Priority Data

Jun. 22, 2021 (KR) ..... 10-2021-0080746

(51) Int. Cl.

| | |
|---|---|
| ***B65B 57/02*** | (2006.01) |
| ***B65B 13/02*** | (2006.01) |
| ***B65B 13/22*** | (2006.01) |
| ***B65B 27/06*** | (2006.01) |

(52) U.S. Cl.
CPC ..... *B65B 57/02* (2013.01); *B65B 13/02* (2013.01); *B65B 13/22* (2013.01); *B65B 27/06* (2013.01)

(58) Field of Classification Search
CPC ..... B65B 57/02; B65B 13/02; B65B 13/22; B65B 27/06
See application file for complete search history.

(56) References Cited

U.S. PATENT DOCUMENTS

| | | | | |
|---|---|---|---|---|
| 2003/0010225 | A1* | 1/2003 | Pearson | B65B 13/06 53/589 |
| 2012/0210674 | A1* | 8/2012 | Perl | B65B 27/04 53/589 |
| 2013/0284033 | A1* | 10/2013 | Bell, Jr. | B65B 13/22 100/32 |
| 2017/0029147 | A1* | 2/2017 | Schuttler | B65B 61/04 |
| 2018/0311716 | A1* | 11/2018 | Yeo | B65B 13/04 |
| 2019/0322397 | A1* | 10/2019 | Vaughn | B65B 13/26 |

* cited by examiner

*Primary Examiner* — Thomas M Wittenschlaeger

(57) ABSTRACT

The present invention relates to strapping head monitoring system for packing coil through selective sensing of binding force of band for packing coil. The system discloses a band sensing unit that selectively senses a band for coil wrapping to obtain binding information of a band for coil wrapping in the strapping head binding a coil through a band for coil wrapping; a binding monitoring unit that selectively controls a binding force of a band for coil wrapping by monitoring a binding force of a band for coil wrapping in real time; and an operator terminal unit that interworks with a binding monitoring unit to enable an operator to control a binding force of a band for coil wrapping in real time.

10 Claims, 11 Drawing Sheets

STRAPPING HEAD MONITORING SYSTEM FOR PACKING COIL THROUGH SELECTIVE SENSING OF BINDING FORCE OF BAND FOR PACKING COIL

TECHNICAL FIELD

The present invention relates to a strapping head monitoring system for packing coil through selective sensing of binding force of band for packing coil. More specifically, in a strapping head for binding the coil, it selectively senses a band for coil wrapping to obtain a binding information of the band for coil wrapping, monitors a binding status of the band for coil wrapping in real time, and collects a packaging quality and a production operation information of a coil product.

BACKGROUND

Recently, the domestic steel industry is pursuing unmanned automation and work standardization of the steel production and packaging process in order to reduce the production cost automatically in accordance with the government's regulations on reducing working hours and intensifying price competition for steel products.

Accordingly, in order to strengthen the global competitiveness of the domestic steel industry, the demand for process automation technology in the steel product production and packaging industry is rapidly increasing by linking all processes from steel production to shipment with a smart factory.

The smart factory manages and analyzes big data generated through all processes of steel product production and packaging to improve the productivity and quality of steel products and prevent equipment failure. The smart factory aims to enhance the competitiveness of the steel industry by building a process automation line based on the technology of the 4th industrial revolution.

In the industry relates to the smart factory, the steel coil product packaging operation process is the last process just before delivery to the customer, and technical attempts are being made to acquire and monitor the data and product information related to the packaging operation in real time.

As an example of a related prior patent document, "a binding head module for coil packaging (Patent Number No. 10-1701205, hereinafter referred to as the prior art 1)" exists.

According to the prior art 1, the system comprises, in the binding head module for coil packaging applied to a binding machine for packaging steel plate coils, a frame comprising a plurality of plates combined; a correction unit disposed on one side of the frame to correct the curvature of the supplied band; feeding unit for transferring the band passing through the correction unit, and applying tension to the band after the band has completely wound the coil; a guide unit for changing the conveying direction of the band conveyed by the feeding unit, and sensing the tension acting on the band; a grip part for clamping and cutting the end of the band; and a fastening part for fastening the overlapping bands.

Another example of a patent document is "a welding system for binding a band for coil wrapping (Patent Number No. 10-1993923, hereinafter referred to as the prior art 2)" exists.

According to the prior art 2, the system comprises, in the welding system for binding a band for coil wrapping, a welding unit in which the band approaches the overlapping area and welds the overlapping area to each other; an arm unit holding at least a part of the welding unit and adjusting and supporting the angle of the welding unit so that the band can be placed on the welding unit; a link unit provided on the arm unit, the link unit having a plurality of links to provide a change in angle of the arm unit; a pressing unit that causes a change in the mechanical structure of the link unit through extension of the length and one end is provided on the link unit.

As another example of the patent document, "Robot binding device for coil packaging (Patent Number No. 10-1343119, hereinafter referred to as the prior art 3)" exists.

According to the prior art 3, the robot binding device for coil packaging includes: a band supply unit supplying a band to be bent from a band roll, a grip unit holding a band used for packaging a coil; a grip robot that supports the grip unit and rotates the grip unit holding the band at the periphery of the coil so that the band is wound around the coil and moves the band to the fastening position; and a head unit that provides a band as a grip unit, supplies the band to guide the band to the grip unit, rewinds the remaining amount of the band at the fastening position, and then fastens the band. The grip unit further includes an auxiliary band grip part that is supported while being bent by the head unit during bending.

Another example of a patent document is "Robot binding device for mobile coil packaging (Patent Number No. 10-0946340, hereinafter referred to as the prior art 4)" exists.

According to the prior art 4, the mobile robot binding device includes: a grip unit for holding a band used for coil packaging; a grip robot supporting the grip unit, rotating the grip unit holding the band around the coil so that the band is wound around the coil, and moving the band to the fastening position; a head unit that provides the band as a grip unit and fastens the band at the fastening position of the band; a head robot supporting the head unit and moving the head unit to the fastening position of the band; and a robot transporter that supports at least one of the head robot and the grip robot, and moves the position of the supported robot.

However, according to the existing prior arts, it is impossible to quickly process work and check the packaging quality in real time in the coil packaging process, and it is impossible to check the abrasion or damage of the core parts of the coil packaging in real time. There is a problem that the productivity and work efficiency of the product are reduced.

SUMMARY OF THE INVENTION

According to the present invention, the strapping head monitoring system for packing coil through selective sensing of binding force of band for coil wrapping has been devised to solve the conventional problems as described above, and presents the following purposes.

First, the process of binding steel coils through a band for coil wrapping is to be monitored in real time.

Second, by monitoring the tensile force and welding state of the band for coil wrapping in real time, it is intended to determine the binding force of the band for coil wrapping.

Third, by monitoring the equipment parts for packaging steel coils in real time, the replacement cycle is identified and diagnostic information is obtained.

The problems to be solved of the present invention are not limited to those mentioned above, and other problems not mentioned will be clearly understood by those skilled in the art from the following description.

According to the present invention, the strapping head monitoring system for packing coil through selective sensing of binding force of band for coil wrapping has the following problem solving means for the purposes to be solved above.

According to the present invention, the strapping head monitoring system for packing coil through selective sensing of binding force of band for coil wrapping comprises in a strapping head for binding the coil through a band for coil wrapping, a band sensing unit provided in the strapping head to selectively sense the band for coil wrapping to selectively acquire binding information of the band for coil wrapping; a binding monitoring unit for selectively controlling a binding force of the band for coil wrapping by monitoring the binding of the coil wrapping band in real time through the binding information of the band for coil wrapping obtained from the band sensing unit; and an operator terminal unit allowing the operator to control the binding force of the band for coil wrapping in real time by interworking with the binding monitoring unit.

According to the present invention, the band sensing unit is disposed adjacent to a predetermined roller inducing the band for coil wrapping into the strapping head.

According to the present invention, the band sensing unit comprises a feeding sensor for selectively measuring a predetermined feeding force applied to the band for coil wrapping by being disposed adjacent to the predetermined roller.

According to the present invention, the band sensing unit further comprises a tension sensor that is disposed adjacent to the overlapping portion of the band for coil wrapping returning one turn around the outer circumferential surface of the coil, and that selectively measures a predetermined tension force applied to the band for coil wrapping through the predetermined roller.

According to the present invention, the band sensing unit further comprises an overlap detector that is disposed adjacent to the overlapping portion of the band for coil wrapping returning one turn around the outer circumferential surface of the coil, and that selectively senses a predetermined overlapping portion where the front end and the rear end of the band for the coil wrapping returning one turn around the outer circumferential surface of the coil.

According to the present invention, the band sensing unit further comprises a welding detector that is disposed adjacent to the overlapping portion of the band for coil wrapping, and the selectively senses whether welding occurs at a predetermined welding point in order to bind the predetermined overlapping portion of the band for coil wrapping.

According to the present invention, the binding monitoring unit comprises a feeding monitor that receives the predetermined feeding force information measured from the feeding sensor, and that selectively monitors that the band for coil wrapping is arranged within the predetermined feeding position with the predetermined feeding force entering within a predetermined force range.

According to the present invention, the binding monitoring unit comprises a feeding monitor that receives the predetermined feeding force information measured from the feeding sensor, and that selectively monitors that the band for coil wrapping is arranged within the predetermined feeding position with the predetermined feeding force entering within a predetermined force range.

According to the present invention, the binding monitoring unit further comprises an overlap monitor that receives the information on the predetermined overlapping portion of the band for coil wrapping sensed from the overlap detection unit, and selectively monitors whether the predetermined overlapping portion belongs to a predetermined overlapping portion.

According to the present invention, wherein the binding monitoring unit further comprises a welding monitor that (i) receives the predetermined welding point information sensed from the welding sensor, (ii) set the at least one criterion of the predetermined welding point regarding the presence or absence, shape, position, size, distortion, gradation, rotation, vector movement, or scratch, and (iii) selectively monitors whether the predetermined welding point belongs to at least one criterion.

According to the present invention, the feeding monitoring unit selectively monitors whether a predetermined mark is formed on the front or rear surface of the band for coil wrapping when the band for coil wrapping is fed by rotation of the predetermined roller.

According to the present invention, the welding monitor selectively corrects the predetermined welding point sensed by the welding sensing unit according to a preset angle.

According to the present invention, the binding monitoring unit further includes a changing signal part that selectively provides a predetermined alarm to the operator terminal unit when a preset time arrives at each of the plurality of preset positions of the strapping head.

According to the present invention, strapping head monitoring system for coil wrapping through selective sensing of binding force of band for coil wrapping provides the following effects.

First, by monitoring the binding process of a steel coil in real time, it is possible to grasp the production status of a steel coil.

Second, by monitoring a tensile force and welding state of a band for coil wrapping in real time, it is possible to measure a binding force of a band for coil wrapping and to check a packaging quality.

Third, by monitoring equipment parts for packaging a steel coil in real time, it is possible to automatically provide replacement cycle information to an operator.

Effects of the present invention are not limited to those mentioned above, and other effects not mentioned will be clearly understood by those skilled in the art from the following description.

DETAILED DESCRIPTION OF THE INVENTION

The strapping head monitoring system for packing coil through selective sensing of binding force of band for packing coil according to the present invention can have various alterations and embodiments, and specific embodiments are shown in diagrams and demonstrated in detail. However, the scope of the present disclosure should be not limited by specific embodiments and the present disclosure may be variously modified and altered with addition, change, deletion or supplement of elements by those skilled in the art to which the present disclosure pertains without departing from essential features of the present disclosure. This is also included in the scope of the present invention's spirit.

Figure 1:
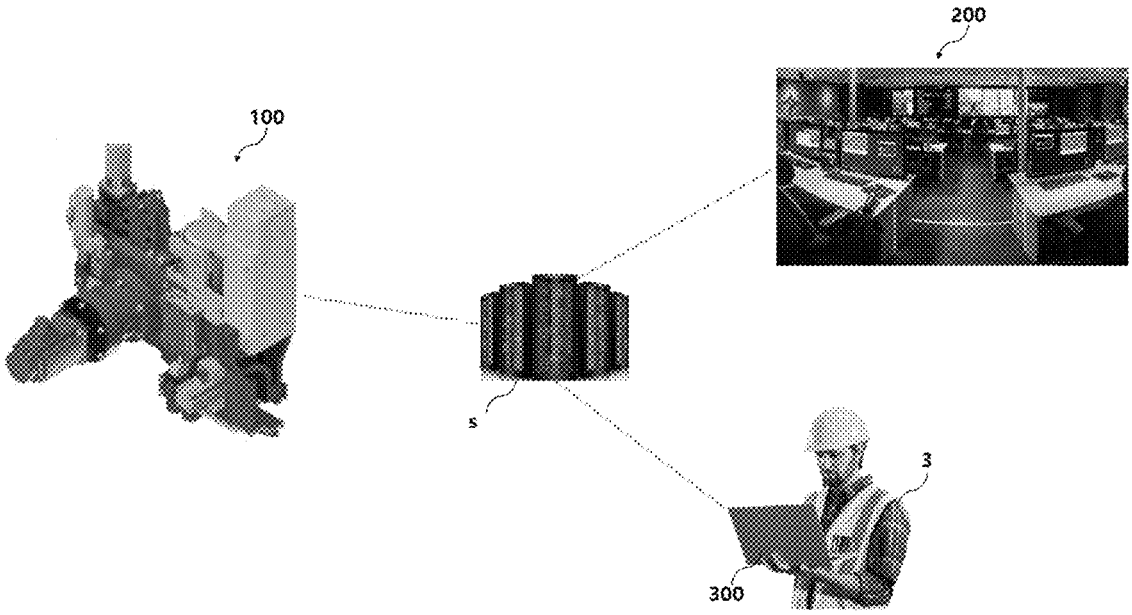
FIG. 1 is a conceptual diagram displaying a strapping head monitoring system for coil packaging through selective sensing of the binding force of a band for coil wrapping according to an embodiment of the present invention.
Figure 2:
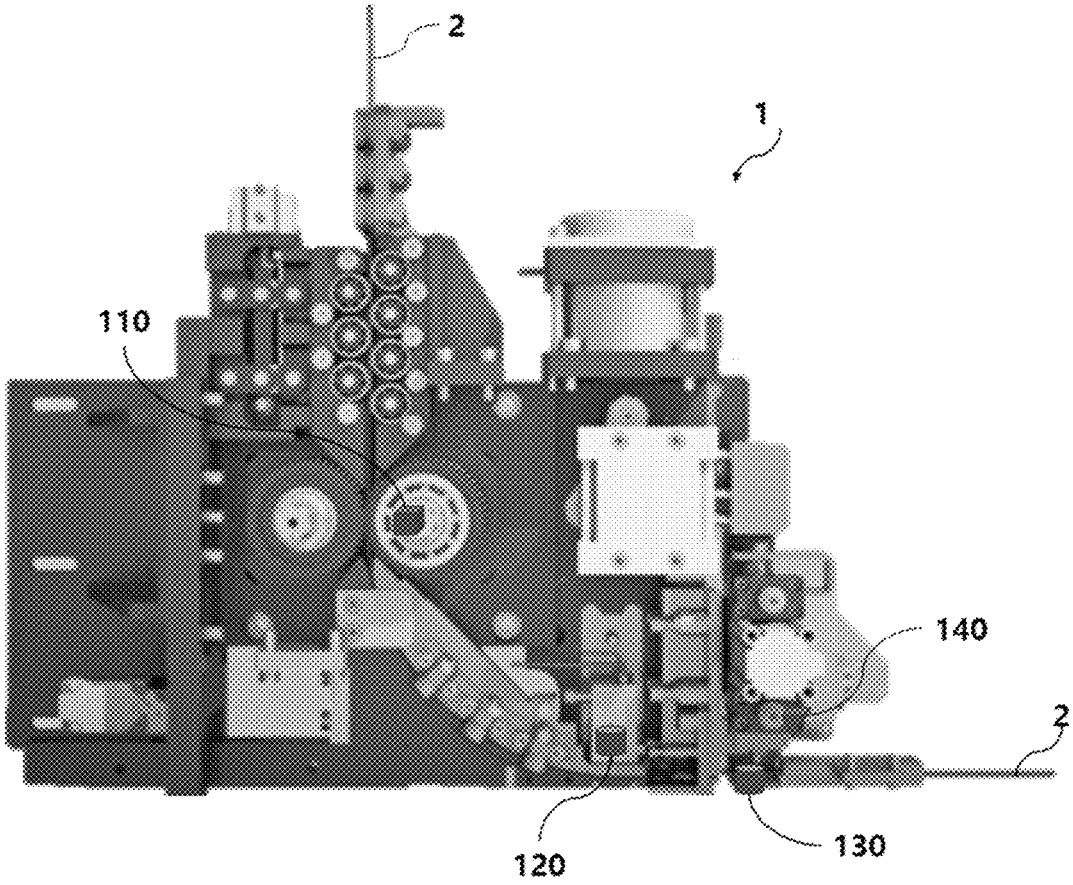
FIG. 2 is a front view displaying the band sensing unit of the strapping head monitoring system for coil packaging through selective sensing of the binding force of the band for coil wrapping according to an embodiment of the present invention.
Figure 3:
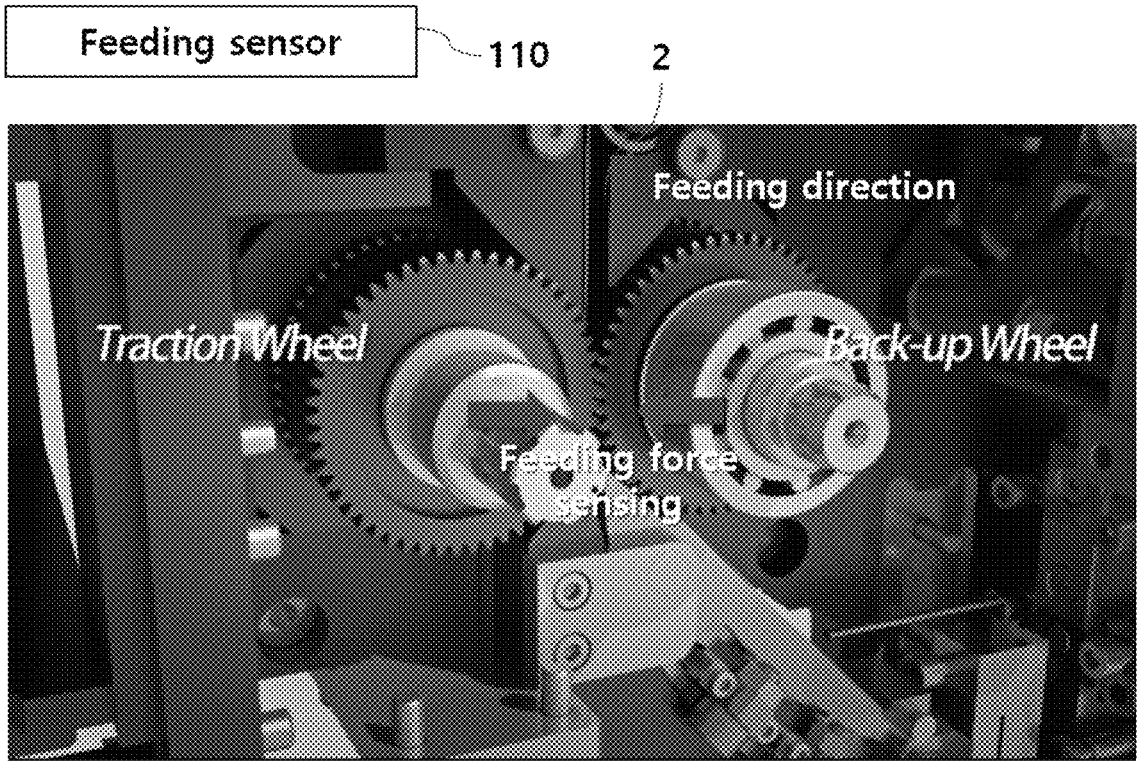
FIG. 3 is a partial perspective view illustrating that a feeding force is sensed through a feeding sensor of the strapping head monitoring system for coil wrapping through selective sensing of the binding force of the band for coil wrapping according to an embodiment of the present invention.
Figure 4:
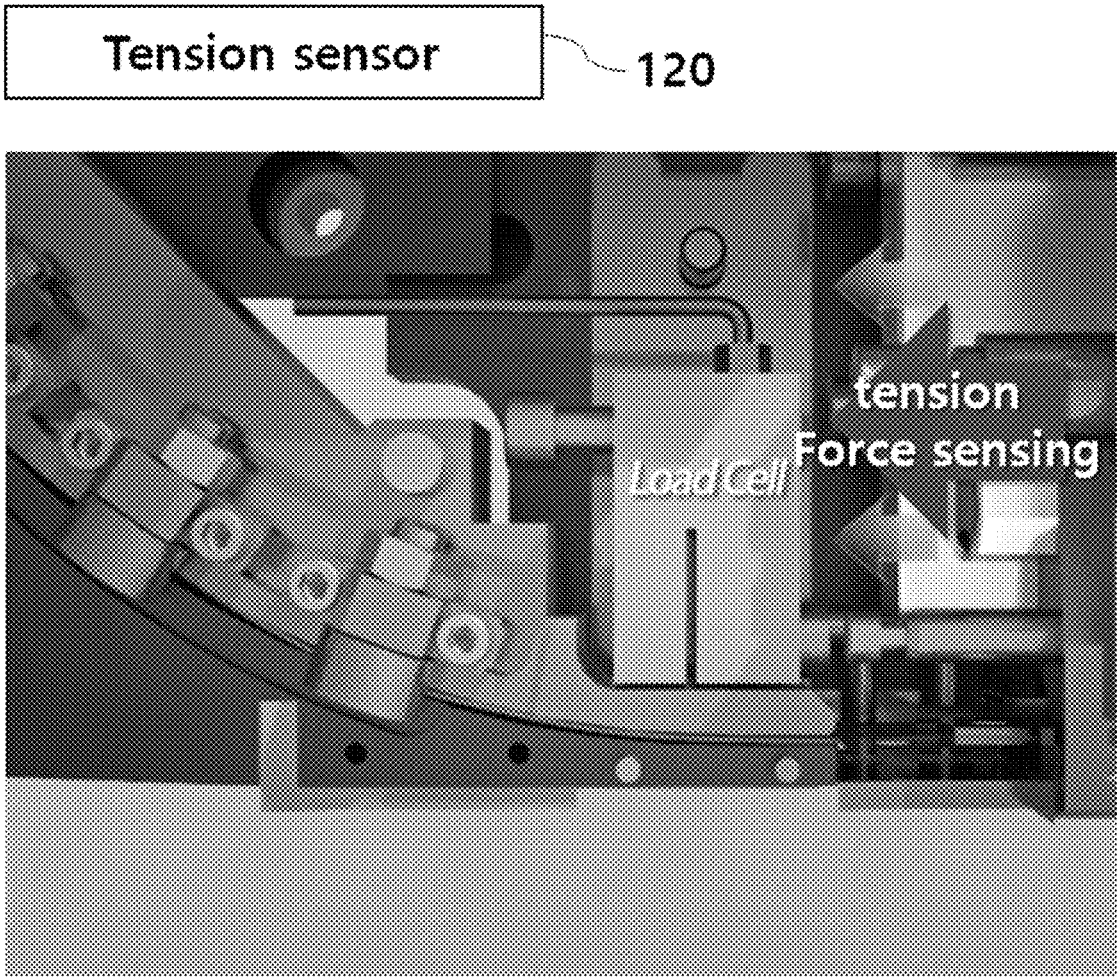
FIG. 4 is a partial perspective view illustrating that a tension force is sensed through a tension sensor of the strapping head monitoring system for coil packaging through selective sensing of the binding force of the band for coil wrapping according to an embodiment of the present invention.
Figure 5:
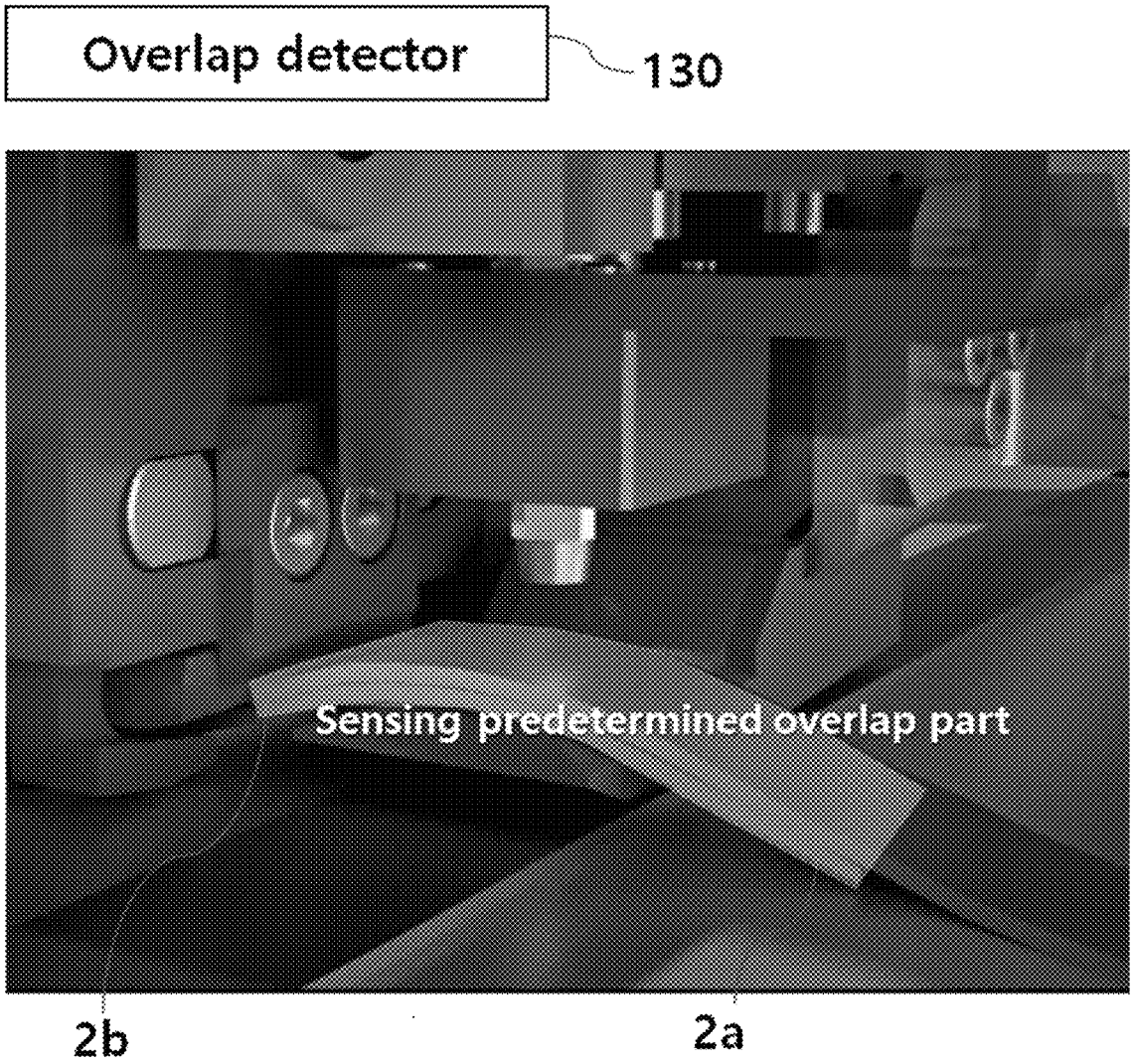
FIG. 5 is a partial perspective view illustrating that an overlapping portion is sensed through an overlap detector of a strapping head monitoring system for coil packaging through selective sensing of a binding force of a band for coil wrapping according to an embodiment of the present invention.
Figure 6:
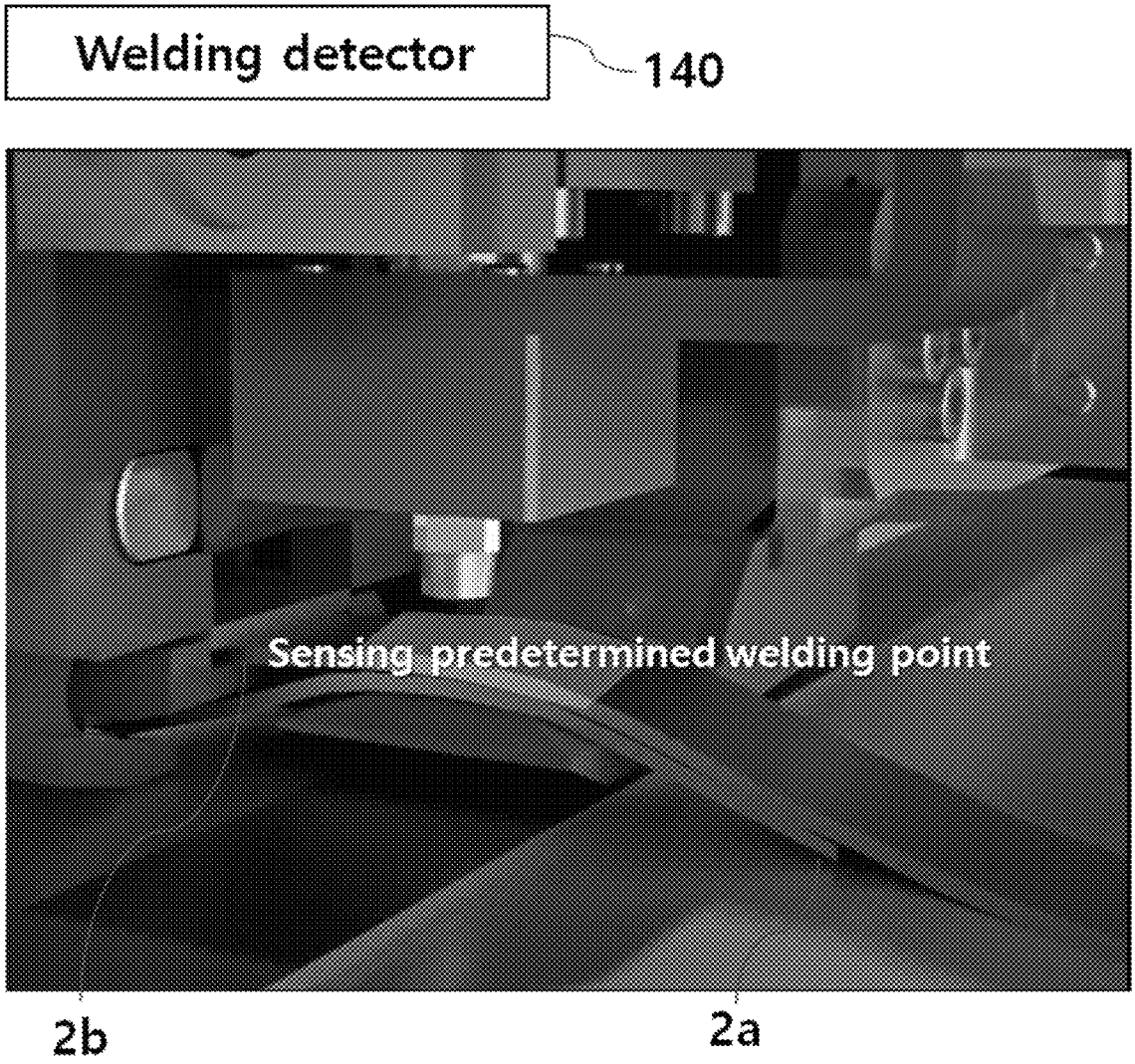
FIG. 6 is a partial perspective view illustrating that a welding point is sensed through a welding detector of a strapping head monitoring system for coil packaging through selective sensing of a binding force of a band for coil wrapping according to an embodiment of the present invention.
Figure 7:
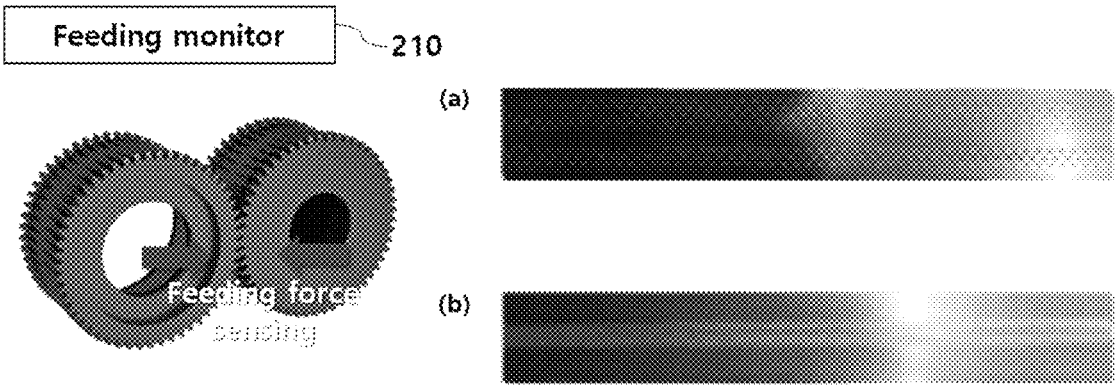
FIG. 7 is a view showing various embodiments of the band for coil packaging confirmed from a feeding monitoring unit of the strapping head monitoring system for coil packaging through selective sensing of the binding force of the band for coil wrapping according to an embodiment of the present invention.
Figure 8:
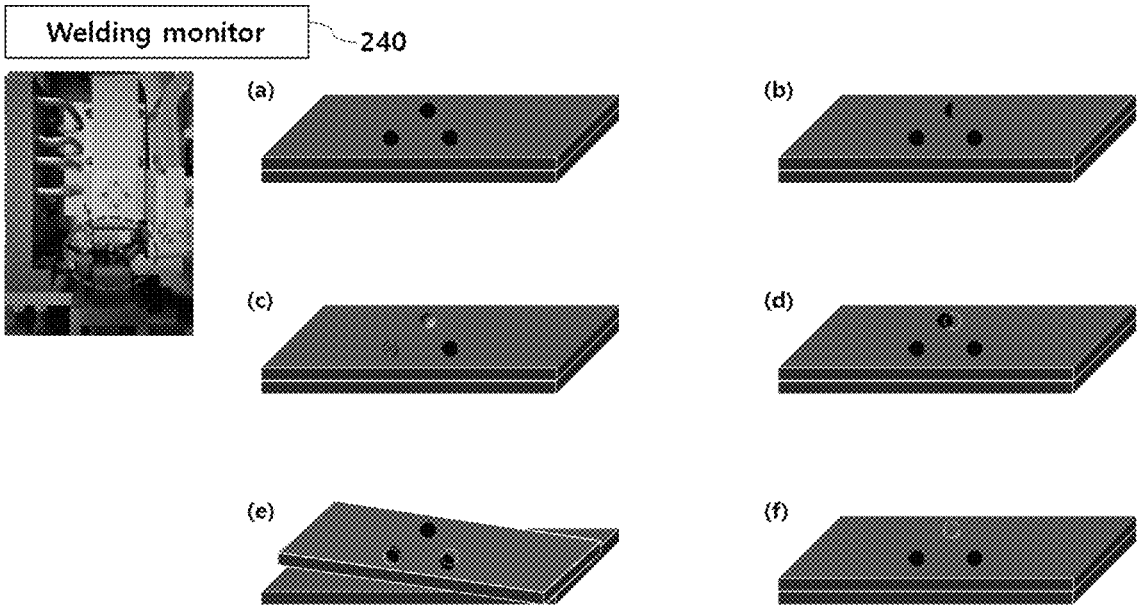
FIG. 8 shows various examples of welding points identified from a welding monitor of the strapping head monitoring system for coil packaging through selective sensing of the binding force of the band for coil wrapping according to an embodiment of the present invention.
Figure 9:
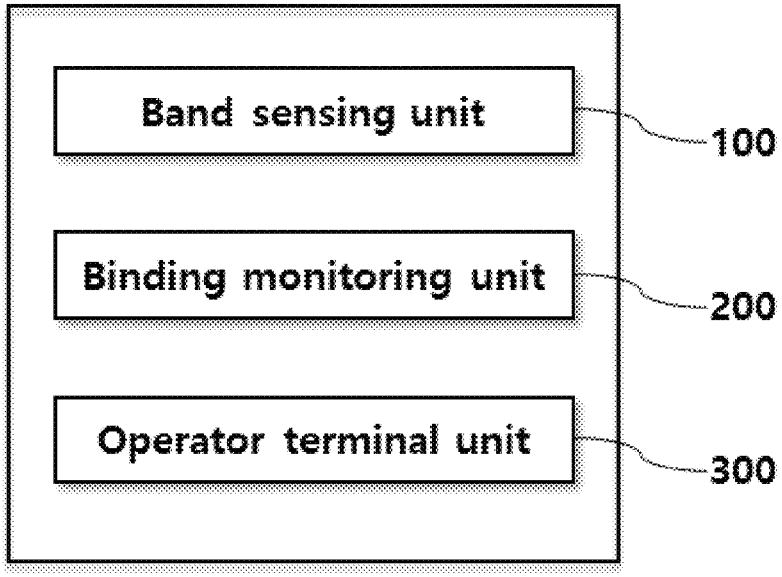
FIG. 9 is a block diagram of a strapping head monitoring system for coil packaging through selective sensing of the binding force of a band for coil wrapping according to an embodiment of the present invention.
Figure 10:
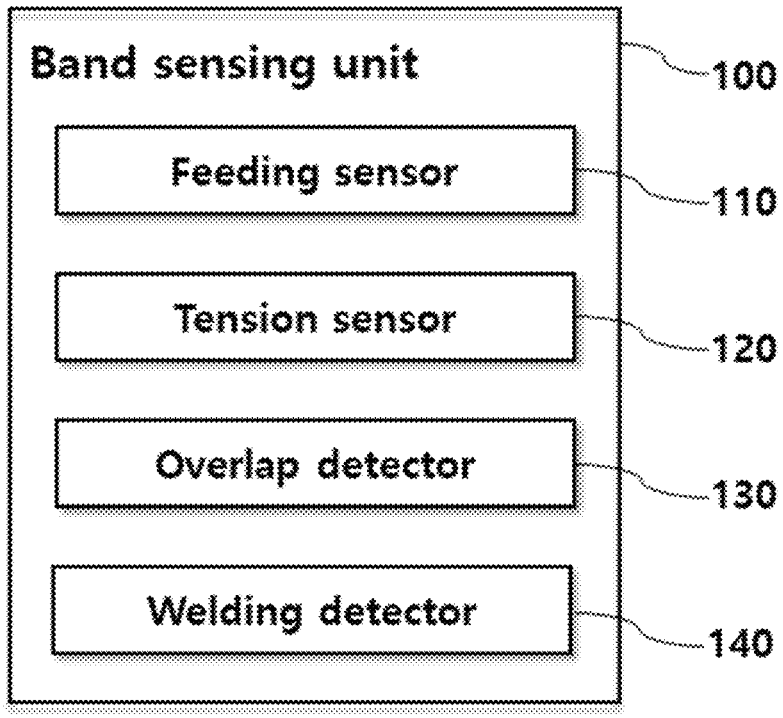
FIG. 10 is a block diagram of a band sensing unit of a strapping head monitoring system for coil packaging through selective sensing of a binding force of a band for coil wrapping according to an embodiment of the present invention.
Figure 11:
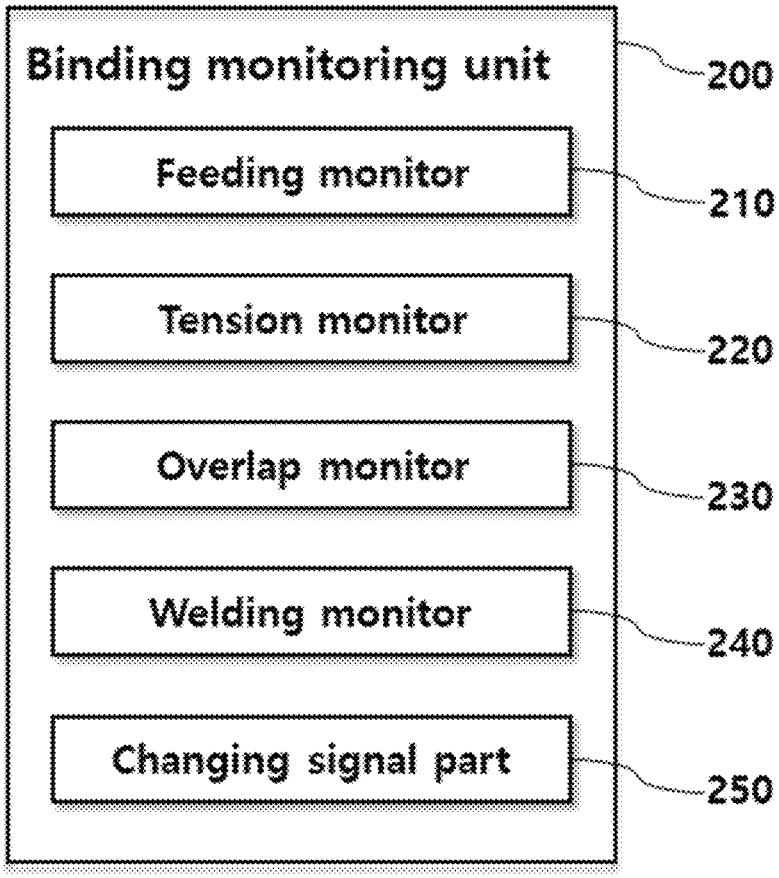
FIG. 11 is a block diagram of a binding monitoring unit of a strapping head monitoring system for coil packaging through selective sensing of a binding force of a band for coil wrapping according to an embodiment of the present invention.

FIG. 1 is a conceptual diagram displaying a strapping head monitoring system for coil packaging through selective sensing of the binding force of a band for coil wrapping according to an embodiment of the present invention. FIG. 2 is a front view displaying the band sensing unit of the strapping head monitoring system for coil packaging through selective sensing of the binding force of the band for coil packaging according to an embodiment of the present invention. FIG. 3 is a partial perspective view illustrating that a feeding force is sensed through a feeding sensor of the strapping head monitoring system for coil wrapping through selective sensing of the binding force of the band for coil wrapping according to an embodiment of the present invention. FIG. 4 is a partial perspective view illustrating that a tension force is sensed through a tension sensor of the strapping head monitoring system for coil packaging through selective sensing of the binding force of the band for coil packaging according to an embodiment of the present invention. FIG. 5 is a partial perspective view illustrating that an overlapping portion is sensed through an overlap detector of a strapping head monitoring system for coil packaging through selective sensing of a binding force of a band for coil wrapping according to an embodiment of the present invention. FIG. 6 is a partial perspective view illustrating that a welding point is sensed through a welding detector of a strapping head monitoring system for coil packaging through selective sensing of a binding force of a band for coil wrapping according to an embodiment of the present invention. FIG. 7 is a view showing various embodiments of the band for coil wrapping confirmed from a feeding monitoring unit of the strapping head monitoring system for coil packaging through selective sensing of the binding force of the band for coil packaging according to an embodiment of the present invention. FIG. 8 shows various examples of welding points identified from a welding monitor of the strapping head monitoring system for coil packaging through selective sensing of the binding force of the band for coil packaging according to an embodiment of the present invention. FIG. 9 is a block diagram of a strapping head monitoring system for coil packaging through selective sensing of the binding force of a band for coil wrapping according to an embodiment of the present invention. FIG. 10 is a block diagram of a band sensing unit of a strapping head monitoring system for coil packaging through selective sensing of a binding force of a band for coil wrapping according to an embodiment of the present invention. FIG. 11 is a block diagram of a binding monitoring unit of a strapping head monitoring system for coil packaging through selective sensing of a binding force of a band for coil wrapping according to an embodiment of the present invention.

According to the present invention, the system is for monitoring a strapping head binding a band for coil wrapping, a coil wrapping band 2 in order to package steel products such as steel coils and pipes using PET bands or STEEL bands.

The strapping head 1 referred to herein, is the binding head for coil wrapping previously applied from prior patents, for example, Patent Publication No. 10-1701205 (received the President's Award in the Republic of Korea Invention Patent Competition 2020), Patent Publication No. 10-1858478, Registered Patent Publication No. 10-1993923, Registered Patent Publication No. 10-2178620, Registered Patent Publication No. 10-2027486, Registered Patent Publication No. 10-2027492, Registered Patent Publication No. 10-2027485, Registered Patent Publication No. 10-1781171. The use, function, and technical characteristics of The strapping head 1 of the present invention are already known in the previously applied prior patents, and detailed descriptions will be omitted here.

In addition, the present invention is a system that compensates for the problems from previously applied patents through data acquisition and monitoring of the binding process related to binding a band for coil wrapping 2 and the binding process, such as the inability of rapid business processing, real-time packaging quality check, to control band real-time and to individually control the band binding force, and the direct confirmation of the wear condition of key parts, and the decrease in productivity and work efficiency.

According to the present invention, as shown in FIGS. 1 and 9, the system comprises a band sensing unit 100, a binding and a binding monitoring unit 200, and an operator terminal unit 300.

First, as shown in FIG. 2, the band sensing unit 100 provided in a strapping head 1, selectively senses a band for coil wrapping 2 in order to obtain information of a band for coil wrapping 2.

The band sensing unit 100 is disposed adjacent to a predetermined roller into which a band for coil wrapping 2 of the strapping head 1 is drawn.

The band for coil wrapping 2 is drawn in from the upper part of the strapping head 1 and moves to the lower part of the strapping head 1 by the feeding force of a predetermined roller (refer to reference numeral 110) to wrap around an outer circumferential surface of the coil.

Binding information of a band for coil wrapping 2 sensed from the band sensing unit 100 desirably comprises a feeding force applied to a band for coil wrapping 2 to wrap an outer circumferential surface of the coil, a tension force for the coil packaging band to adhere to an outer circumferential surface of the coil, information on the overlapping portion where the front end 2*a* and the rear end 2*b* of a band for coil wrapping 2 overlap by a tension force applied to a band for coil wrapping 2, welding point information formed in the overlapping area for binding of a band for coil wrapping 2, surface information of a band for coil wrapping 2.

According to the present invention, as shown in FIG. 10, the system comprises a feeding sensor 110, a tension sensor 120, an overlap detector 130, and a welding detector 140.

First, as shown in FIG. 3, the feeding sensor 110 disposed adjacent to a predetermined roller selectively measures a predetermined feeding force applied to a band for coil wrapping 2.

A predetermined feeding force measured by the feeding sensor 110 is when the band for coil wrapping 2 is drawn in between predetermined rollers, and when predetermined rollers rotate while being engaged, a pressing force is generated on the surface of a packaging band. It can be defined as the force to move the band for coil wrapping 2 by the pressing force.

In addition, feeding direction, feeding speed, feeding position, etc. of a band for coil wrapping 2 may be selectively adjusted according to a predetermined feeding force of the feeding sensor 110.

The feeding sensor 110 is disposed adjacent to a predetermined roller, and it is sufficient to utilize commercially available acceleration sensors, pressure sensors, ultrasonic sensors, vibration sensors, vision sensors, etc., and detailed mechanisms will be omitted.

As shown in FIG. 4, the tension sensor 120 disposed adjacent to the overlapping portion of a band for coil wrapping 2 returning one turn around an outer circumferential surface of the coil, and selectively measures a predetermined tension force applied to a band for coil wrapping 2 by a predetermined roller.

As for the predetermined tension force measured by the tension sensor 120, when a predetermined roller is back driving, tension is applied in the opposite direction to the feeding of a band for coil wrapping 2. At this time, when a desired amount of tension force is applied to a band for coil wrapping 2, it can be in close contact with the outer circumferential surface of the coil.

In addition, according to a measured predetermined tension force of the tension sensor 120, the overlapping portion of the front end 2*a* and the rear end 2*b* of a band for coil wrapping 2 is set, and the range of the overlapping portion can selectively be adjusted.

The tension sensor 120 is disposed adjacent to the overlapping portion of a band for coil wrapping 2, and recognizes the pressure applied to a band for coil wrapping 2, such as a commercially available load cell and a pressure sensor. Therefore, a sensor that converts into an electrical signal can be used, and the detailed mechanism will be omitted.

As shown in FIG. 5, the overlap detector 130 is disposed adjacent to the overlapping portion of a band for coil wrapping 2 returning the outer circumferential surface of the coil one turn, and a predetermined overlapping portion where the front end 2*a* and the end portion 2*b* of a band for coil wrapping 2 returning one turn around a circumferential surface of the coil is selectively sensed.

The overlap detector 130 disposed adjacent to a place where the front end 2*a* and the rear end 2*b* of a band of coil wrapping 2 overlap and seat is to sense the overlapping portion of a band of coil wrapping 2.

A predetermined overlapping portion sensed by the overlap detector 130 is an overlapping point where a band of coil wrapping 2 returns one turn around an outer circumferential surface of the coil and the front end 2*a* and the rear end 2*b* meet. It is to bind a coil through bonding at the overlapping part.

A range of the desired bonding portion of a band for coil wrapping 2 can be selectively adjusted according to a predetermined overlapping portion sensed by the overlap detector 130.

The overlap detector 130 disposed adjacent to the overlapping portion of a band for coil wrapping 2 utilizes an already commercialized vision sensor, infrared sensor, ultrasonic sensor, position sensor, or camera sensor. A detailed mechanism will be omitted.

As shown in FIG. 6, the welding detector 140 disposed adjacent to the overlapping portion of a band for coil wrapping 2 returning one turn around the outer circumferential surface of the coil selectively senses whether welding has occurred at a predetermined welding point in order to bind a predetermined overlapping portion of a band of coil wrapping 2.

A welding detector 140 fixedly disposed where the front end 2*a* and the rear end 2*b* of a band for coil wrapping 2 overlap and seat, and senses the welding to bond a band for coil wrapping 2 at the overlapping portion to bind the coil.

In addition, welding sensed by the welding sensor 140 is mainly spot welding, and when spot welding is performed, the welding point is sensed.

At this time, since the predetermined welding point differs in the number, shape, location, etc. of the welding points required according to the consumer who receives coil product, the desired welding point is set according to the demand of the consumer. a band for coil wrapping 2 is mainly bound through three-point welding, but it is preferable that the number, shape, and position of the welding points are not limited.

The welding senor 140 is disposed adjacent to the overlapping portion of the band for coil wrapping 2, and it is enough to utilize commercially available vision sensors, infrared sensors, ultrasonic sensors, position sensors, camera sensors, etc., the detailed mechanism is omitted.

The binding monitoring unit 200 monitors the binding of a band for coil wrapping 2 through the binding information of a band for coil wrapping 2 obtained from the band sensing unit 100 in real time, and selectively controls the binding force of a band for coil wrapping 2.

As shown in FIG. 1, the binding monitoring unit 200 receives information of a predetermined feeding force, a predetermined tension force, a predetermined overlapping portion, and a predetermined welding point obtained from the band sensing unit 100 through a mediation server(S).

The binding monitoring unit 200 monitors a binding status of a band for coil wrapping 2 in real time, sets self-alarm of a main core component wear cycle for the binding of a band for coil wrapping 2, and thereby grasps a packaging quality and production operation information of coil products in real time.

As shown in FIG. 11, the binding monitoring unit 200 comprises a feeding monitor 210, a tension monitor 220, an overlap monitor 230, a welding monitor 240, and a changing signal part 250.

As shown in FIG. 7, the feeding monitor 210 receives a predetermined feeding force information measured from the feeding sensor 110 and the predetermined feeding force enters within the predetermined feeding force range. It selectively monitors that the band for coil wrapping 2 is prepared in a predetermined feeding position.

The predetermined feeding force referred to herein is defined as a feeding force such that, when a band for coil wrapping 2 is pressed by a predetermined roller, a predetermined mark is not generated on a band for coil wrapping 2 and is provided at a predetermined feeding position.

In addition, a predetermined feeding position refers to a position of a band for coil wrapping 2 determined to wrap the center of an outer circumferential surface of the coil.

For example, when a force greater than or equal to a predetermined feeding force is applied to a band for coil wrapping 2, friction increases between a predetermined roller and the surface of a band for coil wrapping 2, and a band for coil wrapping 2 is damaged. When a force equal to or less than a feeding force is applied, a band for coil wrapping 2 is slipped and a band for coil wrapping 2 is not provided at a predetermined feeding position.

Therefore, it is preferable that the feeding monitor 210 selectively monitors whether a predetermined mark is formed on the front or back of a band for coil wrapping 2 when a band for coil wrapping 2 is fed by rotation of a predetermined roller.

The feeding monitor 210 when a force greater than or equal to a predetermined feeding force is applied to a band for coil wrapping 2, a predetermined mark is formed on the surface such as the front or rear surface of a band for coil wrapping 2 by a predetermined groove (see Patent Publication No. 10-2178620) provided in a predetermined roller. The predetermined mark referred to herein means marks such as wrinkles, scratches and cracks shown in FIG. 7(*a*).

Therefore, the feeding monitor 210 is preferably to monitor a predetermined feeding force in real time so that a predetermined mark is not formed as a band for coil wrapping 2 shown in FIG. 7(*b*).

The tension monitor 220 selectively monitors that a predetermined tension force information measured from the tension sensor 120 is provided, a predetermined tension force enters within a predetermined tension force range, and a band for coil wrapping 2 move into a direction in close contact with an outer circumferential surface of the coil.

A predetermined tension force referred to herein may be defined as an optimized force for a band for coil wrapping 2 to completely adhere to an outer circumferential surface of the coil. When a predetermined tension force is applied to a band for coil wrapping 2, a band for coil wrapping 2 moves in the opposite direction of feeding to form an overlapping portion.

Therefore, the tension monitor 220 monitors in real time that a predetermined tension force enters within a range of a predetermined tension force so that a predetermined overlapping portion is formed in a predetermined overlapping portion.

The overlap monitor 230 receives information on the predetermined overlapping portion of a band for coil wrapping 2 sensed from the overlap detector 130 and selectively monitors whether the predetermined overlapping portion belongs to a predetermined overlapping portion.

A range of an overlapping portion predetermined in the overlap monitor 230 is preferably 30 to 50 mm, and when sensed predetermined overlapping portion information does not belong to a predetermined overlapping portion, a predetermined tension force measured from the tension sensor 120 is controlled so that a predetermined overlapping portion is provided within a range of a predetermined overlapping portion.

The welding monitor 240, as shown in FIG. 8, by receiving the predetermined welding point information sensed from the welding detector 140, by providing at least one criterion of the presence or absence, shape, location, size, distortion, gradation, rotation presence, vector movement, and scratch of a predetermined welding point selectively monitors whether a predetermined welding point belongs to at least one criterion.

As described above, the predetermined welding point information referred to herein may define a desired welding point as set according to a demand or a demand of the consumer. a band for coil wrapping 2 is bound mainly through three-point welding, but it is preferable that the number, shape, and position of the welding points are not limited.

In addition, monitoring whether a predetermined welding point belongs to at least one or more criteria is to reduce a defect rate when binding the coil. It is preferable to regard a welding defect as a welding defect if it falls under at least one of the following criteria: presence or absence of a predetermined welding point, shape, position, size, distortion, gradation, rotation, vector movement, or scratch.

For example, a predetermined welding point in (a) of FIG. 8 is normally formed, a predetermined welding point in (b) of FIG. 8 is a defect in shape during welding, and in (c) of FIG. 8, gradation or scratch occurred at a predetermined welding point. (d) of FIG. 8 shows that an error occurred in the position of a predetermined welding point, and (e) of FIG. 8 shows that a predetermined welding point is twisted or vector moved while a overlapping band for coil packaging is moved during the welding process. (f) of FIG. 8 shows that one of predetermined welding points does not exist, so that a defect has occurred.

In addition, the welding monitor 240 may correct a predetermined welding point sensed by a welding detector 140 according to a preset angle. Since the shape of a predetermined welding point changes depending on the position where the welding detector 140 is disposed, a predetermined welding point is corrected according to a preset angle to accurately determine whether it belongs to at least one or more criteria.

The changing signal part 250 is selectively to provide a predetermined alarm to the operator terminal unit 300 when a preset time arrives at each of a plurality of preset positions of a strapping head 1.

The changing signal part 250 additionally receives and monitors condition information of a strapping head 1 from the band sensing unit 100 from the feeding sensor 110, the tension sensor 120, the overlap detector 130 or the welding detector 140 in real time.

Also, a plurality of preset positions are positions of respective components or parts of a strapping head 1. A preset time may be defined as a replacement cycle of a part or device of a strapping head 1 existing at each of a plurality of preset positions.

That is, when a preset time arrives, a predetermined alarm is provided to give an operator 3 with a replacement cycle and fault diagnosis information.

An operator terminal unit 300 is to interoperate with the binding monitoring unit 200 to allow an operator 3 to control a binding force of a band for coil wrapping 2 in real time.

The operator terminal unit 300 shares binding information of a band for coil wrapping 2 through a terminal possessed by the operator 3, such as a smart phone, a laptop PC, a desktop PC, a tablet PC, and the like, and feeding force, tension force, overlapping area, and welding point of a band for coil wrapping 2 can be selectively controlled.

At this time, the operator terminal unit 300 must be accessed as a conceptual unit of an application installed in each mobile smart phone or a program installed in a PC or a technical function implemented on a web page accessed from these smartphones or PCs.

The scope of the present invention is determined by the matters described in the claims, and parentheses used in the claims are not described for selective limitation, but are used for clear components, and descriptions in parentheses are also essential components should be interpreted as elements.

What is claimed is:

1. A strapping head monitoring system comprises in a strapping head for binding the coil through a band for coil wrapping, wherein the system comprises:

a band sensing unit provided in the strapping head to selectively sense the band for coil wrapping to selectively acquire binding information of the band for coil wrapping;

a binding monitoring unit for selectively controlling a binding force of the band for coil wrapping by monitoring the binding of the coil wrapping band in real time through the binding information of the band for coil wrapping obtained from the band sensing unit; and an operator terminal unit allowing the operator to control the binding force of the band for coil wrapping in real time by interworking with the binding monitoring unit.

2. A strapping head monitoring system according to claim 1, wherein the band sensing unit is disposed adjacent to a predetermined roller inducing the band for coil wrapping into the strapping head.

3. A strapping head monitoring system according to claim 2, wherein the band sensing unit comprises a feeding sensor for selectively measuring a predetermined feeding force applied to the band for coil wrapping by being disposed adjacent to the predetermined roller.

4. A strapping head monitoring system according to claim 3, wherein the band sensing unit further comprises a tension sensor that is disposed adjacent to the overlapping portion of the band for coil wrapping returning one turn around the outer circumferential surface of the coil, and that selectively measures a predetermined tension force applied to the band for coil wrapping through the predetermined roller.

5. A strapping head monitoring system according to claim 4, wherein the band sensing unit further comprises an overlap detector that is disposed adjacent to the overlapping portion of the band for coil wrapping returning one turn around the outer circumferential surface of the coil, and that selectively senses a predetermined overlapping portion where the front end and the rear end of the band for the coil wrapping returning one turn around the outer circumferential surface of the coil.

6. A strapping head monitoring system according to claim 5, wherein the band sensing unit further comprises a welding detector that is disposed adjacent to the overlapping portion of the band for coil wrapping, and the selectively senses whether welding occurs at a predetermined welding point in order to bind the predetermined overlapping portion of the band for coil wrapping.

7. A strapping head monitoring system according to claim 3, wherein the binding monitoring unit comprises a feeding monitor that receives the predetermined feeding force information measured from the feeding sensor, and that selectively monitors that the band for coil wrapping is arranged within the predetermined feeding position with the predetermined feeding force entering within a predetermined force range.

8. A strapping head monitoring system according to claim 4, wherein the binding monitoring unit further comprises a tension monitor that receives the predetermined tension force information measured from the tension sensing unit, enters the predetermined tension force enters within a predetermined tension force range, and selectively monitors that the band for coil wrapping moves in a direction in close contact with the outer circumferential surface of the coil.

9. A strapping head monitoring system according to claim 5, wherein the binding monitoring unit further comprises an overlap monitor that receives the information on the predetermined overlapping portion of the band for coil wrapping sensed from the overlap detection unit, and selectively monitors whether the predetermined overlapping portion belongs to a predetermined overlapping portion.

10. A strapping head monitoring system according to claim 6, wherein the binding monitoring unit further comprises a welding monitor that (i) receives the predetermined welding point information sensed from the welding sensor, (ii) set the at least one criterion of the predetermined welding point regarding the presence or absence, shape, position, size, distortion, gradation, rotation, vector movement, or scratch, and (iii) selectively monitors whether the predetermined welding point belongs to at least one criterion.

* * * * *